United States Patent [19]

Urbaniak

[11] 3,947,960

[45] Apr. 6, 1976

[54] WAND HAIR CUTTER

[76] Inventor: Walter Urbaniak, 1275 Lansdowne Ave., Camden, N.J. 08104

[22] Filed: Mar. 5, 1973

[21] Appl. No.: 338,259

[52] U.S. Cl. ..... 30/30; 30/53

[51] Int. Cl.[2] ..... B26B 21/12

[58] Field of Search ..... 30/30, 31, 53, 82, 337, 30/338, 339

[56] References Cited

UNITED STATES PATENTS

| | | | |
|---|---|---|---|
| 1,104,570 | 7/1914 | Stevens | 30/53 |
| 1,608,581 | 11/1926 | Caruso | 30/30 |
| 1,616,813 | 2/1927 | Lloyd | 30/339 |
| 2,041,003 | 5/1936 | Leahy | 30/337 |
| 2,588,033 | 3/1952 | O'Gatty | 30/31 |
| 3,599,329 | 8/1971 | Calandra | 30/30 |

*Primary Examiner*—Al Lawrence Smith
*Assistant Examiner*—Gary L. Smith
*Attorney, Agent, or Firm*—Morton C. Jacobs

[57] ABSTRACT

A wand hair cutter device includes an elongated handle with a razor blade holder attached to the end thereof in end-to-end relation. The blade seats between two flat portions of the device and is retained in position by means of a clasp in the end thereof for easy removal and replacement. Wedge-shaped teeth control light trimming of the hair, and the razor blade is exposed on another face of the device for shaving and sharp line cutting.

1 Claim, 9 Drawing Figures

43
47
47
40
42
41
38

20
44
14
26
12

18
16
46
34
34
50
32
32
14
30

18
48
45
14
22
24
26
26
28

16
38
22
24
24

38
24
22
14
24

12
10

24
16
34
24
18
22
36

24
34
22

WAND HAIR CUTTER

BACKGROUND OF THE INVENTION

This invention relates to hair cutting devices and particularly to the type using a replaceable safety blade.

Hair cutter devices having a handle at one end and a cutter at the other end, somewhat in the form of a wand, have been suggested for use both in professional hair cutting and also for men and women to cut their own hair and to style it and shape it. Representative patents illustrating such hair cutter devices including U.S. Pat. Nos. 2,530,918; 2,141,340; 1,976,290; 1,262,292; and 1,227,548.

Desirable features of such hair cutters are that the blade and cutter portion be located at the extreme end of the device, so that the user can reach around to any portion of his own head with the wand and perform the hair cutting operation. The device should be light in weight and easy to clean. It should be constructed so that only small quantities of hair are removed with any particular cutting stroke, and the device should be of safety construction so that the user cannot cut his skin accidentally.

SUMMARY OF THE INVENTION

An object of this invention is to provide a new and improved hair cutter device.

Another object is to provide a new and improved hair cutter device which is simple in construction and effective in operation.

Another object is to provide a new and improved hair cutter device which is economical in construction.

Another object is to provide a new and improved hair cutter device which may be used with replaceable double-edge safety blades and is effective to retain those blades in safe condition and wherein it is a relatively simple matter to remove them and replace them.

BRIEF DESCRIPTION OF THE DRAWING

The foregoing and other objects of this invention, the various features thereof, as well as the invention itself, will be more fully understood from the following description when read together with the accompanying drawing, in which.

In the drawing, corresponding parts are referenced throughout by similar numerals.

DESCRIPTION OF A PREFERRED EMBODIMENT

Figures 1, 2, 3, 4, 5, 6, 7, 8, 9:
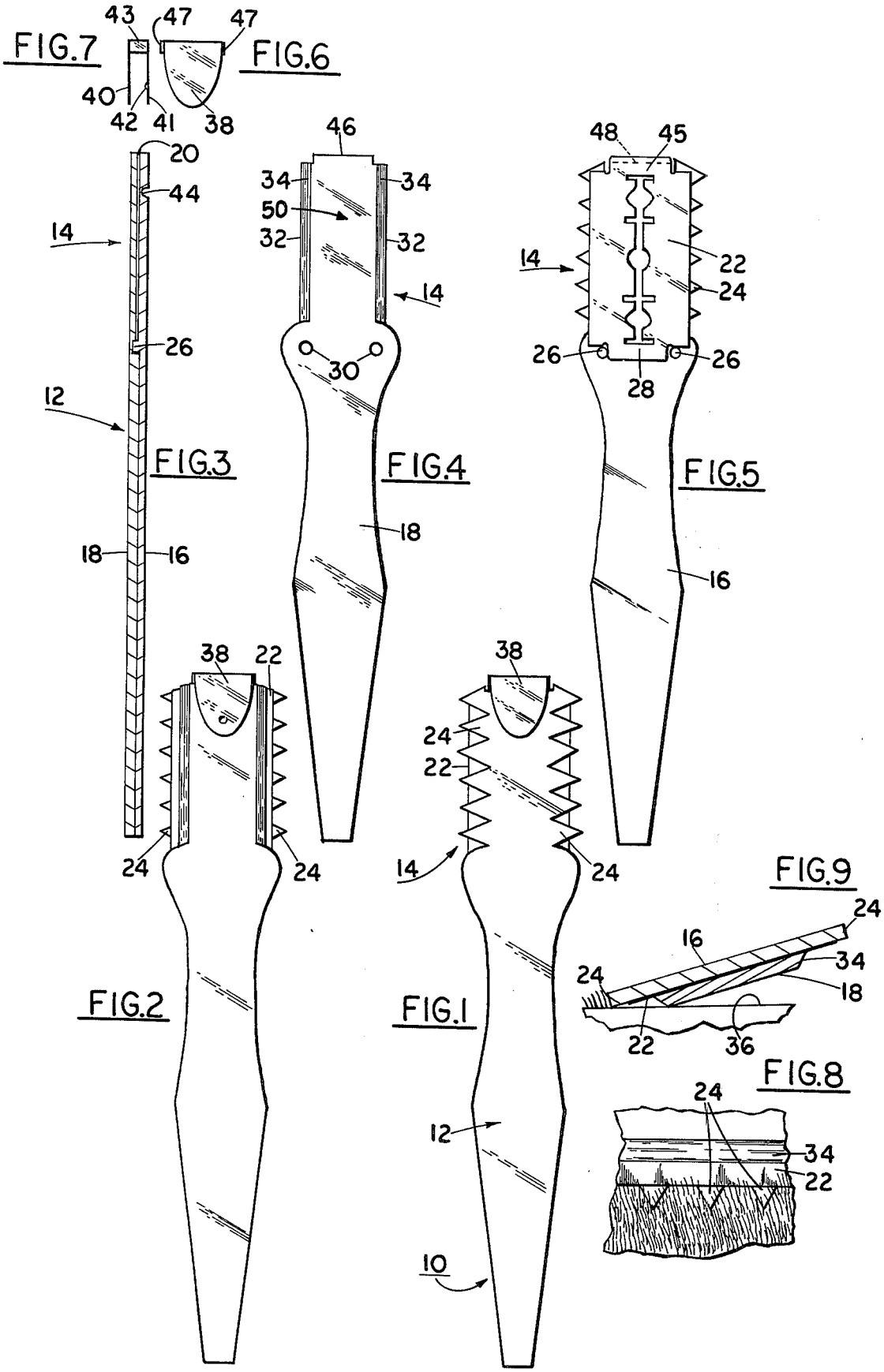
FIG. 1 is a top view of a wand hair cutter device embodying this invention.
FIG. 2 is a bottom view of the hair cutter of FIG. 1.
FIG. 3 is an edge view of the cutter of FIG. 1 with the safety blade and a holder clasp removed therefrom.
FIG. 4 is a bottom view of one of two sections forming the device of FIG. 1.
FIG. 5 is an inside bottom view of the other of the two sections forming the device of FIG. 1 and illustrated with a double-edge safety safety razor blade in operating position therein.
FIG. 6 is a face view of a spring clasp used for retaining a safety blade in operating position used in the device of FIG. 1.
FIG. 7 is a side view of the clasp of FIG. 6.
FIG. 8 is an enlarged bottom view similar to that of FIG. 2, illustrating the cutter section of the device of FIG. 1.
FIG. 9 is an enlarged sectional view of the device of FIG. 1, illustrating the safety location of the razor blade in the shaving mode of operation.

The wand hair cutter device 10 of FIG. 1 is formed with a handle portion 12 and a cutter portion 14 in end-to-end relation. The handle portion 12 may be shaped in any stylized form convenient for use and for holding either within the palm of the hand or between the fingers for movement of the cutter portion around to any part of the person's head. The device 10 is formed as a generally unitary member from two sections 16 and 18, in one form of the invention, which sections are fabricated of flat, plastic material which is relatively stiff and the sections being bonded together throughout the length of the handle portion 12 and spaced apart at the cutter portion 14 to form a recess 20 of a thickness of about 1/100 inch, suitable to receive a double-edge safety blade 22 therebetween. The cutter may be formed in various ways to achieve the bifurcated cutter portion 14 which is open at its extreme end and closed at the handle end of the device. In the form of the invention illustrated in the drawing, each of the two sections 16 and 18 is formed of plastic material of about 1/16 inch thick and about an inch in overall width.

The section 16 has teeth 24 of triangular or V-shape formed along the opposite edges of the cutter portion 14. About a half dozen such teeth 24 are formed within the length of about 1¼ inches that corresponds to the cutter edge of a standard razor blade. These teeth may take a number of different shapes. A very convenient and effective form for trimming action is that of the illustrated zig-zagged wedge shape, in which the blade is located across the teeth part way down. The section 16 also carries a pair of circular pins 26 which are spaced about ½ inch to carry the rectangular tongue 28 that is commonly formed on the ends of double-edge razor blades, and which is used in this invention for purposes of seating the blade 22 firmly in operating position.

The section 18 has a pair of circular holes 30 that receive the pins 26 that project internally from the inside surface of section 16. Section 18, at the cutter portion 14, has two straight edges 32 recessed back from the extreme position of the teeth 24, as may be best seen in the sectional view of FIG. 9. The recessed edge 32 serves to fully expose and retain the edge of the razor blade to permit shaving action, when that razor edge is adjacent to the skin surface 36 (FIG. 9) of the user. In that condition, the edge of the teeth 24, and the edge of the bevel 34 on the section 18, is such that the edge of the blade 22 is barely in contact with the skin surface 36 so that there is no danger of the blade 22 cutting the user's skin or cutting a finger if that should accidentally come in contact in the position shown in FIG. 9, so that the safety construction prevents accidental cutting of the user even if his fingers should touch the blade 22 when it is properly retained within the holder.

A clasp 38 is formed in a U-shape with two fingers 40 and 41 that embrace the sections 18 and 16 at their open ends to retain the razor blade 22 in the recess 20 and in proper operating condition. The finger 41 has a projection 42 which nests into a dimple 44 on the face of the section 16 to retain that clasp in position. The web 43 of the clasp 38 is generally flat and closely abuts internally the extreme end of the projecting blade tongue 45, which extends beyond the correspondingly rectangular outer ends 46 and 48 of sections 18 and 16 of the cutter portion 14. Overhanging the clasp on either side are portions 47 which enclose the projecting blade tongue 45 as well as the rectangular holder edges 46 and 48. With this construction, the blade 22 is located directly at the outer end of the wand.

In use, a blade is inserted into the recess 20 of the cutter portion of the device 10, with the insertion operation being generally through the side space of that recess 20 as well as through the open end of the recess. The blade is turned into operating position so that it is retained with its tongue 28 between the pins 26. Thereupon the clasp 38 is snapped in place to close the open end and retain the tongue 45 within the clasp holding it firmly in operating position. The removal of the blade may be performed in a similar fashion but in reverse order, with the clasp 18 being removed and the blade simply turned through the recess until it can be held between the fingers and thereby pulled out the remainder of the way. The projection of the blade tongue 45 beyond the edges 46 and 48 permits ready access to turn the blade 22 through the recess 20 for removal.

The hair cutting operation is easily performed by a user with any portion of the head being readily accessible using the same hand (e.g. the right hand) of the user. With the wedge shaped teeth in contact with the hair for trimming as shown in FIG. 8, the hair located between the teeth is the only hair having access to the blade 22. The teeth rest on and glide over the hair, and the blade picks up the hair between the teeth. The teeth also tend to enter below the top hairs as greater pressure is applied, which, due to the wedge shaped teeth, is manifested as greater resistance to the light stroking action. Thus there is a blending, trimming action in this trimming position of the cutter, and the user can control the depth of his strokes. Successive stroking of a section of the hair makes it as short as desired without the blunt look of a scissor cut, and insures a neat trimmed look of the hair. The V-shaped teeth are also effective in trimming wet hair as well as dry hair, with the teeth entering below the top hairs as directed by the user. The wedge shape tends to move the hairs laterally as the teeth glide through the hair. With the teeth 24 located on opposite edges, it is possible for the user to retain the wand in the same hand for working on opposite sides of his own head. With the section 18 adjacent to the skin 36, as shown in FIG. 9, a shaving or sharp trimming action can be achieved such as at the neckline or sideburns. Thus the wand hair cutter of this invention may be used with the ease and safety of an ordinary comb, and at the same time trimming or shaping is achieved. Moreover, the same unit may be operated effectively with either the left or the right hand.

The device is light in weight, inexpensive in construction, and easy to keep clean. The blades are easily removed and replaced, and safety handling of the unit is insured. Various modifications of this invention will be apparent from the above description. For example, various materials may be used, and the unit may be formed as a single bifurcated member rather than the bonded sections as shown. In addition, in place of a clasp, the razor blade may be held in place by a pin or screw between the sections 16 and 18 and passing through one of the holes in the blade. The generally flat inside surface 50 of section 18 may be slightly hollow to form more efficient clamping action at the edges 32 against the blade 22. In addition, mating grooves may be formed in the inside faces of sections 16 and 18 just below the pins 26, so as to receive any hairs that collect between the two sections and from which they can be removed by a small brush. Also, section 18 is preferably warped outwardly from about the middle of the blade holder portion to the edge 46 to form a somewhat wider opening 20 for easy insertion of the blade 22 and to provide tighter clamping of that blade when the clasp 38 is attached.

Thus, a new and improved wand hair cutter is provided which is simple and economical in construction and effective in operation.

What is claimed is:

1. In a hair cutter comprising an elongated member having a handle portion and a cutter portion in end-to-end relation, the improvement therein of:

said cutter portion including two closely spaced fixed thin sections having generally flat opposing surfaces of generally uniform thickness and forming a holder for a replaceable double-edge safety-razor blade of a certain width, said blade holder sections being attached adjacent the handle end and open adjacent the other end to receive a blade therein, one of said sections have opposite toothed edges and the other of said sections having opposite substantially straight edges, said toothed edge section being substantially wider than said straight edge section to form a separate space between each of said toothed edges and the adjacent one of said straight edges for respectively locating the cutter edges of a razor blade means for operationally positioning an inserted flat blade between said flat surfaces with the cutter edges thereof substantially parallel to said straight edges and adjacent said toothed edges and overlying the teeth thereof, and respectively located in said spaces between said straight and toothed edges; said straight edge section having a certain thickness to form outer straight edges that serve as shaving-position rests against the skin of the user for the opposite cutter edges of the razor blade, said shaving rest edges of said straight edge section and the outer toothed edges of said toothed edge section forming a certain shaving plane on each side of said razor blade holder, said entire flat blade being positioned between said shaving planes with the cutter edges thereof adjacent said shaving planes;

said positioning means including two spaced indexing pins between said blade holder sections and at the handle end of said cutter portion to seat spaced portions of the end of an inserted blade, said indexing pins projecting normally from one of said opposing surfaces and through mating holes in the other of said opposing surfaces to align said fixed sections to form said shaving plane; and means for closing said open holder end to retain the blade therein, said means for closing said open holder end including a removable U-shaped clasp for embracing substantially the full width of the section ends at said open end, said clasp bearing against the end of an inserted blade to retain said blade in operational position against said indexing pins, and including detent means in one of the legs thereof for completing a reliable connection with said holder, said clasp including overhanging side portions to enclose the opposite edges of an inserted blade at said open section end;

whereby the user may safely cut straight edges of his hair with the straight edge section adjacent his hair and trim any part of his hair with the toothed section adjacent his hair and using either hand in each case.

* * * * *